US007878138B2

(12) United States Patent
Lambertus

(10) Patent No.: US 7,878,138 B2
(45) Date of Patent: Feb. 1, 2011

(54) APPLIANCE FOR DEPLOYMENT AND TRACKING OF AN UNMANNED UNDERWATER VEHICLE

(75) Inventor: Detlef Lambertus, Osterholz-Scharmbeck (DE)

(73) Assignee: Atlas Elektronik GmbH, Bremen (DE)

( * ) Notice: Subject to any disclaimer, the term of this patent is extended or adjusted under 35 U.S.C. 154(b) by 313 days.

(21) Appl. No.: 12/086,150

(22) PCT Filed: Sep. 27, 2006

(86) PCT No.: PCT/EP2006/009371

§ 371 (c)(1),
(2), (4) Date: Jun. 6, 2008

(87) PCT Pub. No.: WO2007/065495

PCT Pub. Date: Jun. 14, 2007

(65) Prior Publication Data

US 2009/0151617 A1 Jun. 18, 2009

(30) Foreign Application Priority Data

Dec. 7, 2005 (DE) ..... 10 2005 058 475

(51) Int. Cl.
*B63G 7/08* (2006.01)

(52) U.S. Cl. ..... 114/312

(58) Field of Classification Search ..... 114/312, 114/313, 322, 259
See application file for complete search history.

(56) References Cited

U.S. PATENT DOCUMENTS

| | | | | |
|---|---|---|---|---|
| 3,880,103 | A * | 4/1975 | Talkington | 405/185 |
| 5,370,074 | A | 12/1994 | Knudsen et al. | |
| 5,378,851 | A * | 1/1995 | Brooke et al. | 114/259 |
| 5,752,460 | A | 5/1998 | Buffman et al. | |
| 6,279,501 | B1 * | 8/2001 | Taylor, Jr. | 114/312 |

FOREIGN PATENT DOCUMENTS

| | | |
|---|---|---|
| EP | 1 582 445 | 10/2005 |
| WO | WO 92/00220 | 1/1992 |

* cited by examiner

*Primary Examiner*—Ed Swinehart
(74) *Attorney, Agent, or Firm*—Fitch, Even, Tabin & Flannery; Norman N. Kunitz

(57) ABSTRACT

An appliance for lowering and tracking an underwater vessel includes a carrier arranged on an end of a holding cable; a holding device on the carrier used to receive/release the underwater vessel with a controllable holding element; and a tracking device arranged on the carrier and used for acoustically determining the position of the underwater vessel lowered into the water. As a result, a light, compact lowering appliance is provided that is suitable for handling vessels on small platforms and ensures acoustically undisturbed operation of the tracking device, which is arranged on one end of the carrier, the carrier being mounted such that it can be pivoted on the holding cable in an articulated manner in a central longitudinal region thereof. Following release of the underwater vessel from the holding element, a pivoting device pivots the carrier including the tracking device out of a lowering position, into a tracking position.

9 Claims, 3 Drawing Sheets

APPLIANCE FOR DEPLOYMENT AND TRACKING OF AN UNMANNED UNDERWATER VEHICLE

CROSS-REFERENCE TO RELATED APPLICATIONS

This application is the National Stage filing under 35 U.S.C. §371 of International Application PCT/EP2006/009371, filed Sep. 27, 2006, and claims priority of German Patent Application 10 2005 058 475.6, filed Dec. 7, 2005, the subject matter of which, in their entireties, is incorporated herein by reference.

BACKGROUND OF THE INVENTION

The invention relates to an appliance for deployment and tracking of an unmanned underwater vehicle as claimed in the precharacterizing clause of claim 1.

Unmanned underwater vehicles are used, for example, for mine destruction, are remotely controlled from an airborne or waterborne platform, such as a helicopter or surface vessel, and are deployed into the water from the platform. A deployment appliance is used for this purpose and has a carrier which holds the underwater vehicle in a holder and is attached to a holding cable. The holding cable is unwound from the platform. The deployment appliance is advantageously equipped with a tracking apparatus which allows the unmanned underwater vehicle that has been deployed into the water and is a distance from the deployment appliance to be tracked, that is to say allows its position to be determined continuously. The tracking apparatus operates on the SSBL or USBL principle and has a plurality of hydrophones, which are arranged at a distance from one another, for receiving the sound pulses which are transmitted by a responder arranged on the underwater vehicle. The bearing angle to the underwater vehicle is calculated from the time-shifted reception of the sound pulses and from the phase shift that results from this between the electrical hydrophone output signals, and the distance to the underwater vehicle is calculated from the delay time of the sound pulses between the responder and the tracking device.

In a system for detection and destruction of underwater mines (EP 0 535 044 B1), the unmanned underwater vehicle which is equipped with an explosive charge is remotely controlled from a submerged platform, and the position of the underwater vehicle is determined continuously using a tracking apparatus, which is arranged on the platform and operates in the manner described above. The platform has a deployment appliance for deploying the underwater vehicle into the water.

It has already been proposed for an underwater platform such as this with a tracking device to itself be in the form of a deployment appliance for an unmanned underwater vehicle. The underwater platform is attached to a deployment cable and, for example, is lowered into the water from a helicopter. The holding apparatus for the unmanned underwater vehicle is arranged on the underneath of the platform, and the platform is equipped with its own electric-motor propulsion system. Once the platform has been deployed and has been released from the deployment cable, the platform is stabilized about its roll, pitch and yaw axes by means of vertically and horizontally acting maneuvering drive systems. The three-dimensional stabilization of the tracking device that this results in allows the position of the underwater vehicle to be found accurately even in poor sea-weather conditions, greatly reducing the risk of loss of tracking, that is to say of the acoustic link between the underwater vehicle and the tracking device breaking down. A three-dimensionally stabilized deployment appliance such as this has a relatively large volume, is heavy and is highly complex to manufacture.

The invention is based on the object of providing a lightweight, physically small deployment appliance with a tracking apparatus for an unmanned underwater vehicle, which is also suitable for handling on small platforms and ensures that the tracking apparatus operates acoustically without interference.

SUMMARY OF THE INVENTION

According to the invention, the object is achieved by the features of claim 1.

The appliance according to the invention for deployment and tracking of an unmanned underwater vehicle has the advantage that the pivoting of the carrier after the underwater vehicle has been released results in the tracking apparatus being located at the deepest point of the carrier, with the acoustic performance of the tracking apparatus, in particular the acoustic link to the underwater vehicle, not being interfered with, or being interfered with only to a minor extent, by components on the carrier, such as the holder for the underwater vehicle. The elongated carrier, which is deployed vertically into the water, with the tracking apparatus arranged at its lower end means that the tracking apparatus is held in a sufficiently stable manner in the water, thus ensuring reliable position measurement of the underwater vehicle. An attitude sensor which, for example, is in the form of a compass stabilized on three axes, in the tracking apparatus provides information about the alignment of the hydrophone arrangement of the tracking device, and this is then included in the evaluation of the phase shift of the electrical hydrophone output signals.

Expedient embodiments of the deployment appliance according to the invention as well as advantageous developments and refinements of the invention will become evident from the further claims.

According to one preferred embodiment of the invention, the tracking apparatus is arranged at that end of the carrier which faces that part of the holding apparatus which grips the stern of the unmanned underwater vehicle. This has the advantage that the tracking apparatus cannot be damaged when the underwater vehicle is being unlatched from the holding apparatus, as a result of the front part of the holding apparatus, which grips the bow of the underwater vehicle, pivoting away.

According to one advantageous embodiment of the invention, the pivoting apparatus has a spring, which can be loaded by moving the carrier, preferably manually, to its deployment position. In this deployment position, the carrier is locked to the holding cable by means of a detachable locking apparatus.

BRIEF DESCRIPTION OF THE DRAWINGS

The invention will be described in more detail in the following text with reference to one exemplary embodiment, which is illustrated in the drawing.

DETAILED DESCRIPTION OF THE INVENTION

Figure 1:
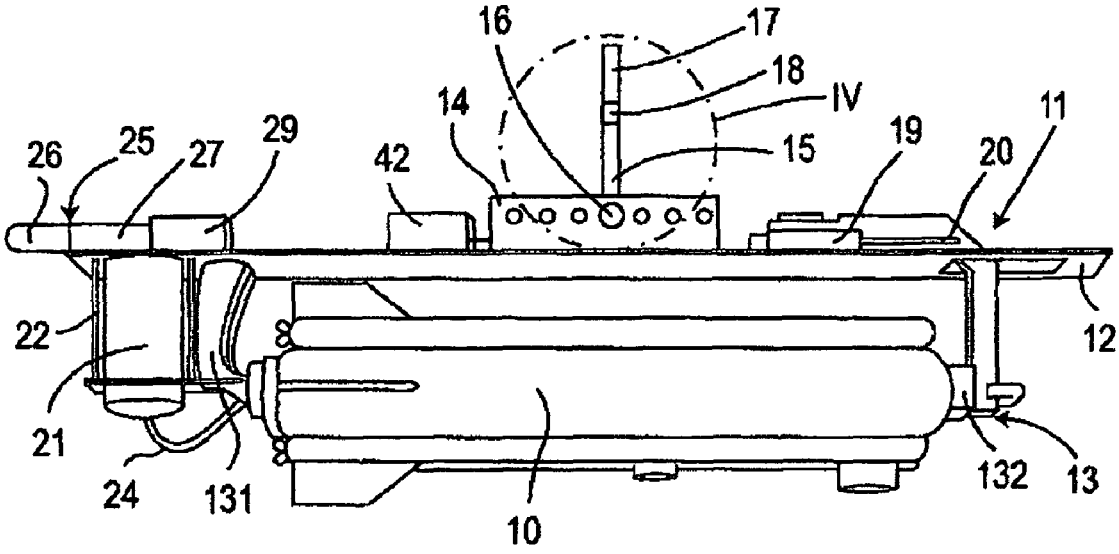
FIG. 1 shows a side view of a deployment appliance, in its deployment position, with an unmanned underwater vehicle accommodated in a holding apparatus.

FIG. 1 shows a perspective side view of the appliance 11 for deployment and tracking of a physically small, unmanned underwater vehicle 10, having an elongated, narrow carrier 12 in the form of a plate, on whose underneath a holding apparatus 13 is arranged for the underwater vehicle 10 to be latched into. On its top, the carrier 12 has, approximately centrally, two attachment flanges 14 which are opposite one another and spaced apart, and between which an attachment lug 15 is positioned. A rotating bolt 16 passes through the two attachment flanges 14 and the attachment lug 15, and holds the carrier 12 on the attachment lug 15 such that it can pivot. The attachment lug 15 forms the appliance-side, free end of a holding cable 17, by means of which the carrier 12 is deployed with the underwater vehicle 10 from a platform into the water. In general, the platform for this purpose has a cable winch, by means of which the holding cable 17 can be fed out and retrieved again. Signal and power supply lines run in the interior of the holding cable 17. The platform may be airborne or waterborne, for example in the form of a helicopter or a surface vessel. In general, a damping element 18 is also arranged between the holding cable 17 and the attachment lug 15, in order to largely reduce shocks affecting the deployment appliance 11 when the deployment process is stopped quickly.

The holding apparatus 13 has a rear holding element 131, which is arranged fixed to the carrier 12, and a front holding element 132, which is arranged on the carrier 12 such that it can pivot. At least one hydraulic or compressed-air cylinder 19 is provided in order to pivot the front holding element 132, and acts via at least one piston rod on the front holding element 132, which is mounted on the carrier 12 such that it can pivot.

Figure 2:
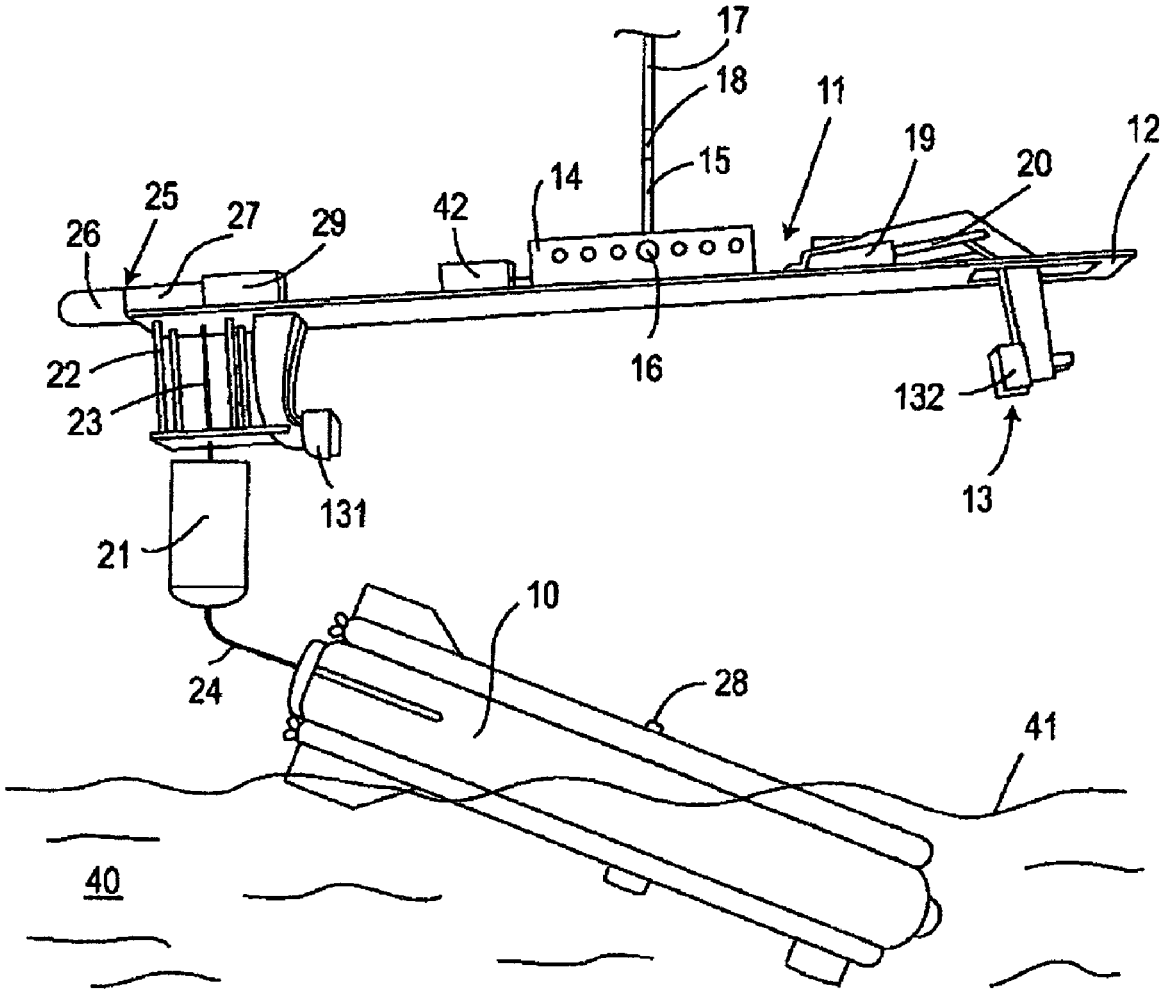
FIG. 2 shows the same illustration as that in FIG. 1 after the underwater vehicle has been unlatched from the holding apparatus and at the moment when the underwater vehicle enters the water.

As can be seen in FIG. 1, the stern of the underwater vehicle 10 is latched into the rear holding element 131, and its bow is latched into the front holding element 132, by the front holding element 132 being pivoted downwards, and thus closing the holding apparatus 13. In order to unlatch the underwater vehicle 10, the front holding element 132 is pivoted slightly upwards by means of the hydraulic or compressed-air cylinder 19, as a result of which the front holding element 132 releases the bow of the underwater vehicle 10, and the latter falls out of the rear holding element 131 by virtue of its weight. This is illustrated in FIG. 2.

Figure 3:
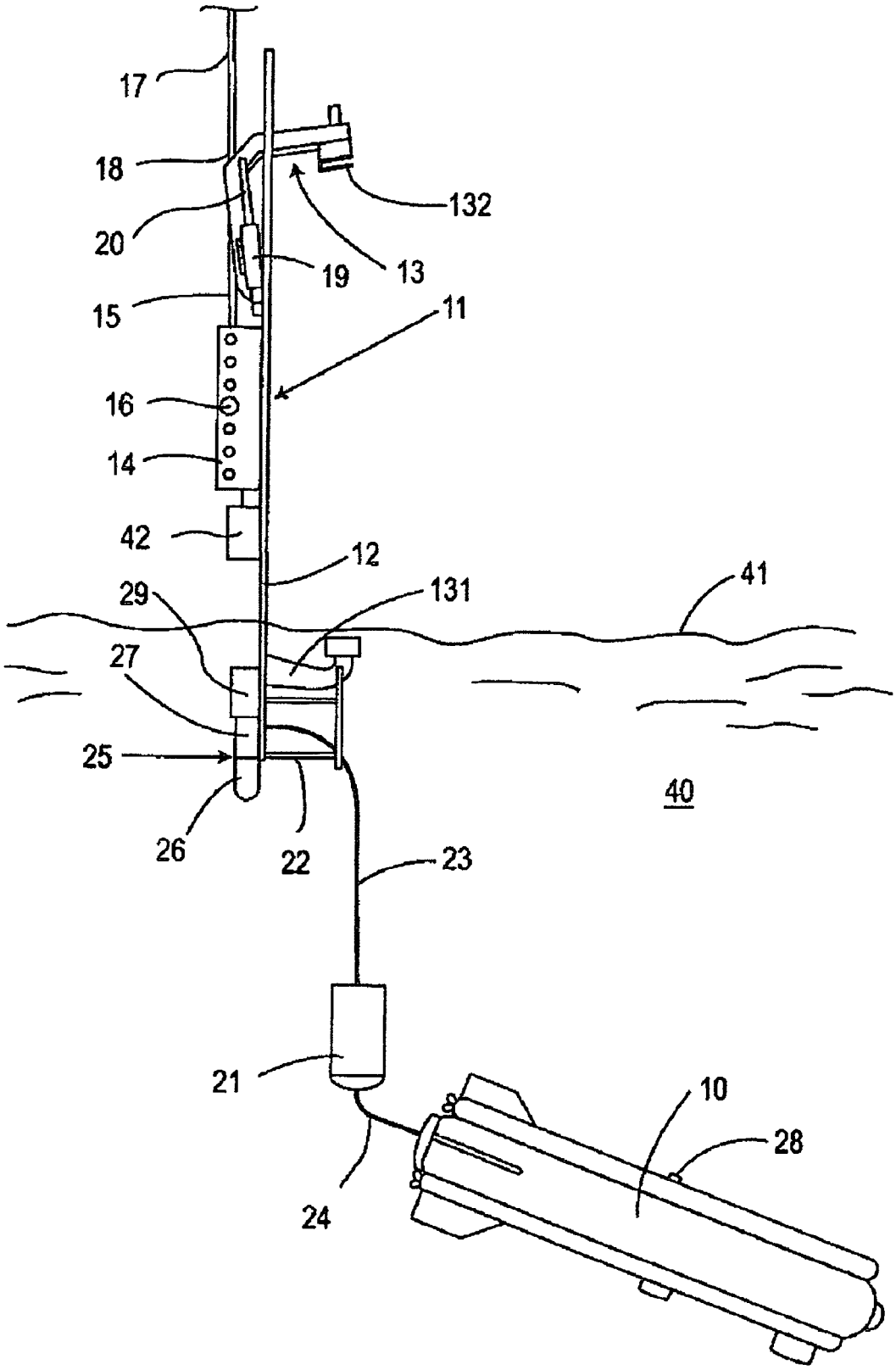
FIG. 3 shows the same illustration as that in FIG. 1, with the underwater vehicle deployed in the water and the deployment appliance in the tracking position.

In the exemplary embodiment, the underwater vehicle 10 is connected to the deployment appliance 11 via a signal cable with a small cross section. A glass-fiber cable 24 is normally used as the signal cable and is unwound from two glass-fiber spools during movement of the underwater vehicle 10. One glass-fiber spool is located in the stern of the underwater vehicle 10, and the other glass-fiber spool is accommodated in a spool receptacle 21 arranged on the carrier 12. The spool receptacle 21 is held in a cage 22 and is locked against falling out. As or immediately after the front holding element 132 of the holding apparatus 13 is pivoted upwards, the lock on the spool receptacle 21 in the cage 22 is also released, so that the spool receptacle 21 falls out of the cage and sinks into the water 40 until a connecting cable 23 between the spool receptacle 21 and the carrier 12 is stretched tight (FIG. 3). As soon as the spool receptacle 21 has reached its final position in the water 40 and the electrical propulsion systems for the underwater vehicle 10 have been activated, the glass-fiber cable 24 is unwound from the spool receptacle 21, and is at the same time unwound from the glass-fiber spool arranged in the stern of the underwater vehicle 10, so that the glass-fiber cable 24 is not subjected to any tensile load, or only to a small tensile load.

At its rear free end, where the cage 22 is also arranged, the carrier 12 has a tracking apparatus 25 for tracking the underwater vehicle as it moves away. As is illustrated schematically in FIG. 1, the tracking apparatus 25 comprises a hydrophone arrangement 26 which projects beyond the free end of the carrier 12, and an attitude sensor 27 which, for example, is a three-axis-stabilized compass. The hydrophone arrangement 26 comprises, in a known manner, a plurality of hydrophones at a distance from one another, and receives sound pulses transmitted from a responder 28 arranged on the underwater vehicle 10. An evaluation unit 29 downstream from the hydrophone arrangement uses the phase shifts between the electrical hydrophone output signals and in taking account of the alignment of the hydrophone arrangement, which is measured by the attitude sensor 27, to calculate a bearing angle to the underwater vehicle 10. The sound pulses are initiated electrically in the responder 28 via the glass-fiber cable 24, and the evaluation unit 29 measures the delay time of the sound pulses from the underwater vehicle 10 to the hydrophone arrangement 26, and uses this to calculate the distance between the underwater vehicle 10 and the deployment appliance 12. The position of the underwater vehicle 10 can be found at any time from the bearing angle and the distance.

A pivoting apparatus 30 for pivoting the carrier 12 from its deployment position, in which the underwater vehicle 10 can be unlatched from the holding apparatus 13, to a tracking position, in which the tracking apparatus 25 is located at the maximum distance below the articulation point of the carrier 12 on the holding cable 17, that is to say at the maximum distance below the rotating bolt 16, is located between the carrier 12 and the holding cable 17, to be more precise between the carrier 12 and the attachment lug 15 on the holding cable 17. Since the carrier 12 is aligned approximately at right angles to the holding cable 17 when in its deployment position, the pivoting apparatus 30 rotates the carrier 12 through about 90°. The pivoting apparatus 30 is inactive in the deployment position of the carrier 12 with the holding apparatus 13 closed, and is activated on or after opening of the holding apparatus 13 and the unlatching of the underwater vehicle 10 associated with this.

Figure 4:
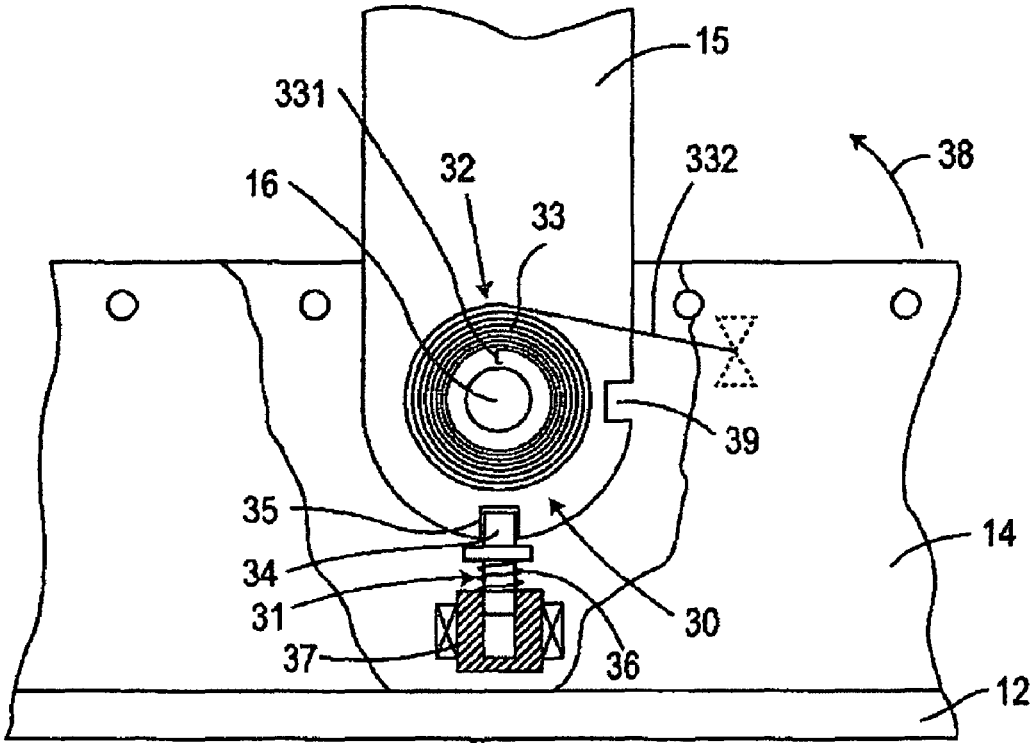
FIG. 4 shows a schematic, enlarged illustration of the detail IV in FIG. 1.

The pivoting apparatus 30 has a spring 32 which is loaded in the deployment position of the carrier 12, and a detachable locking apparatus 31 which, when the spring 32 is loaded, locks the carrier 12 in its deployment position on the holding cable 17, to be more precise on the attachment flange 14 of the holding cable 17 (FIG. 4). In the schematically illustrated exemplary embodiment, the spring 32 is a spiral spring 33 whose inner spring limb 331 is fixed to the attachment lug 15, and whose outer spring limb 332 is fixed to the front attachment flange 14 of the carrier 12 in FIG. 4. The locking apparatus 31 has a spring-loaded blocking element 34 which is arranged such that it can move axially on the rear attachment flange 14 in FIG. 4, and a locking groove 35 which interacts with the blocking element 34 and is formed in the attachment lug 15.

When the carrier 12 is in the deployment position as illustrated in FIG. 4, the front end of the blocking element 34 is pushed into the locking groove 35 by the locking spring 36. The carrier 12 and the holding cable 17 are therefore firmly connected to one another. In the exemplary embodiment, the locking apparatus 31 can be released by means of an electromagnet 37, which is lifted out of the locking groove 35 when current flows through the blocking element 34, which forms the armature of the electromagnet 37. The influence of the spiral spring 33 pivots the carrier 12, from which the underwater vehicle 10 has been released, in the direction of the arrow 38 in FIG. 4. That end of the carrier 12 to which the tracking apparatus 25 is fitted, is pivoted downwards, and enters the water 40, as is illustrated in FIG. 3. The attachment lug 15 has a second locking groove 39, which is offset through an angle of 90° with respect to the locking groove 35. During the pivoting movement of the carrier 12 relative to the attachment lug 15 on the holding cable 17, with the electromagnet 37 unlocked, the spring-loaded blocking element 34 enters the second locking groove 39 and locks the carrier 12, which is aligned approximately parallel to the holding cable 17, in this position as illustrated in FIG. 3.

If the aim is to deploy an underwater vehicle 10 from a platform in a sea region, then the carrier 12 is first of all manually pivoted to a rotation position in which it is aligned approximately horizontally. During this pivoting movement of the carrier 12, the spiral spring 33 is loaded, and the locking apparatus 31 becomes effective at the end of the pivoting movement, as a result of the blocking element 34 entering the locking groove 35 under the influence of the locking spring 36. The underwater vehicle 10 is now inserted into the holding apparatus 13, and the holding apparatus 13 is closed via pivoting the front holding element 132. The spool receptacle 31 is inserted into the cage 20, and is likewise locked in it.

The deployment appliance 11 with the underwater vehicle 10 latched in the holding apparatus 13 is now lowered to the water surface 41 from the platform by paying out the holding cable 17. A release control unit 42 arranged on the carrier 12 activates the hydraulic or compressed-air cylinder 19, which pivots the front holding element 132 upwards so that it is lifted off the bow of the underwater vehicle 10. The released underwater vehicle 10 falls out of the rear holding element 131 and enters the water through the surface 41, as is illustrated in FIG. 2. As the underwater vehicle 10 falls out, this also releases the spool receptacle 21, which falls out of the cage 22 and likewise enters the water 40 through the water surface 41, in order then to sink until the connecting cable 23 is stretched tight. Once the underwater vehicle 10 and the spool receptacle 21 have fallen out, current is passed through the release control unit 42 of the electromagnet 37, as a result of which the blocking element 34 is pulled out of the locking groove 35. The loaded spiral spring 33 rotates the carrier 12 in the direction of arrow 38 (FIG. 4) until the spring-loaded blocking element 34 enters the second locking groove 39. The tracking apparatus 35 is at the maximum distance below the rotating bolt 16 and enters the water 40 through the water surface 41. The holding cable 17 is now paid out further until the entire deployment appliance is submerged below the water surface. The tracking apparatus 25 assumes an optimum attitude below the water surface 41 and can maintain an acoustic link, without interference, with the responder 28 in the underwater vehicle 10 during the movement of the underwater vehicle 10.

The invention claimed is:

1. An appliance for deployment and tracking of an unmanned underwater vehicle having an elongated carrier which is arranged at the end of a holding cable, having a holding apparatus, which is arranged on the carrier for holding the underwater vehicle, which holding apparatus has a controllable holding element for unlatching the underwater vehicle from the holding apparatus, and having a tracking apparatus, which is arranged on the carrier for acoustically finding the position of the underwater vehicle which is being deployed in the water, wherein the tracking apparatus is arranged at one end of the elongated carrier, the carrier is articulated on the holding cable in a central longitudinal area of the carrier such that the carrier can pivot, and a pivoting apparatus, which can be activated once the underwater vehicle has been unlatched from the holding apparatus, is provided in order to pivot the carrier from a deployment position, in which the underwater vehicle is deployed, to a tracking position, in which the tracking apparatus is located, preferably as far as possible, below the carrier articulation point on the holding cable.

2. The appliance as claimed in claim 1, wherein the tracking apparatus is arranged at that end of the carrier which faces a rear holding element, which grips the stern of the underwater vehicle, of the holding apparatus.

3. The appliance as claimed in claim 1, wherein the carrier is aligned approximately at right angles to the holding cable in its deployment position, and is aligned approximately parallel to the holding cable in its tracking position.

4. The appliance as claimed in one of claim 1, wherein the pivoting apparatus has a spring, which can be loaded by moving the carrier to its deployment position, and a detachable locking apparatus, which locks the carrier to the holding cable at least in its deployment position.

5. The appliance as claimed in claim 4, wherein the locking apparatus can be released with a time delay when the holding apparatus is unlatched.

6. The appliance as claimed in claim 4, wherein the end of the holding cable is formed by an attachment lug on which the articulation point of the carrier is provided by a rotating bolt, and the spring is a spiral spring, one of whose spring ends is fixed to the attachment lug, and whose other spring end is fixed to the carrier.

7. The appliance as claimed in claim 6, wherein the locking apparatus has a spring-loaded blocking element and a locking groove which holds the blocking element, which are formed alternately on the attachment lug and on the carrier, and the blocking element can be pulled out of the locking groove mechanically or electromagnetically against the spring force of a locking spring.

8. The appliance as claimed in claim 4, wherein the carrier is latched to the holding cable in its tracking position.

9. The appliance as claimed in claim 8, wherein the blocking element is arranged on the carrier and the attachment lug has two of said locking grooves which are offset through 90 degrees, with one said locking groove holding the spring-loaded blocking element when the carrier is in the deployment position, while another one said locking groove holds the spring-loaded blocking element when the carrier is in the tracking position.

* * * * *